US005967516A

United States Patent [19]

Phillips

[11] Patent Number: 5,967,516

[45] Date of Patent: Oct. 19, 1999

[54] TIME PIECE GAME

[76] Inventor: Murray Phillips, 7332-8th Avenue, Regina, Saskatchewan, Canada, S4T 0W9

[21] Appl. No.: 09/079,276

[22] Filed: May 15, 1998

Related U.S. Application Data

[60] Provisional application No. 60/050,646, Jun. 24, 1997.

[51] Int. Cl.[6] ..... A63F 3/06; A63F 9/24

[52] U.S. Cl. ..... 273/138.2; 273/138.1; 368/3; 368/10; 463/16

[58] Field of Search ..... 368/3, 10, 96; 273/138.1, 138.2, 139, 143 R; 463/20, 16

[56] References Cited

U.S. PATENT DOCUMENTS 4,188,779 2/1980 Fatton ..... 273/138.2

4,395,134 7/1983 Luce ..... 368/3

FOREIGN PATENT DOCUMENTS 51-153625 10/1978 Japan ..... 368/10

52-139514 6/1979 Japan ..... 368/10

2111729 7/1983 United Kingdom ..... 368/10

*Primary Examiner*—Benjamin H. Layno

*Attorney, Agent, or Firm*—Adrian D. Battison; Murray E. Thrift

[57] ABSTRACT

A game apparatus for playing a game by a plurality of players is defined by a collection of visually identical watches each having a processor for calculating and displaying a time and a date. At least one of the watches is arranged to display to a player holding that watch at a predetermined time and date, such as at the millennium, an indication that that watch is a winner of the game.

4 Claims, 1 Drawing Sheet

TIME PIECE GAME

This Application has a Provisional Application No. 60/050,646 filed Jun. 24, 1997.

BACKGROUND OF THE INVENTION

This invention relates to a game apparatus for playing a game by a plurality of players including time pieces such as a watch or clock.

SUMMARY OF THE INVENTION

According to the invention, therefore, there is provided a game apparatus for playing a game by a plurality of players comprising a plurality of time pieces each having means for calculating and displaying a time and a date, at least one of the time pieces being arranged to display to a player at a predetermined time and date an indication that said at least one time piece is a winner of the game, all of said time pieces being arranged such that said at least one time piece is not visually determinable by the players to be different from the other time pieces until said display of said indication.

Preferably all of the time pieces are substantially identical.

Preferably each of the time pieces includes a display means for displaying said indication and wherein only said one time piece is programmed to activate said display.

Preferably the time pieces are arranged such that said predetermined time and date is midnight Dec. 31 st, 1999.

In the game, therefore, the game apparatus or time pieces are sold to individual players with a part of the selling price being collated into a pool for a prize to be paid to one or more of the players as a winner of the game.

The winning indication is therefore displayed on one or more selected ones of the time pieces so that, at the predetermined time and date which can be any significant event, all of the players are involved in watching the time pieces so that they can see the display of a winner.

The primary intention is that the game be played at the end of the century for commencement of the next millennium but any other significant date and event can be selected.

The time pieces are arranged so that it is not possible to visually determine or determine by inspection which of the time pieces is going to indicate the winning condition. Suitable steps are taken to ensure security so that it is not possible for example to tamper with the time piece to change it into a winner or to determine which ones are winners prior to the event. The programming may therefore prevent a user from changing the date and time to the predetermined set time so as to determine in advance whether a particular time piece is a winner. Alternatively, the winning indication may be maintained only for a short period of time and may require that the winner declare the winning time piece within a predetermined time period so as to prevent players from determining in advance which time pieces are winners.

DETAILED DESCRIPTION

Figure 1:
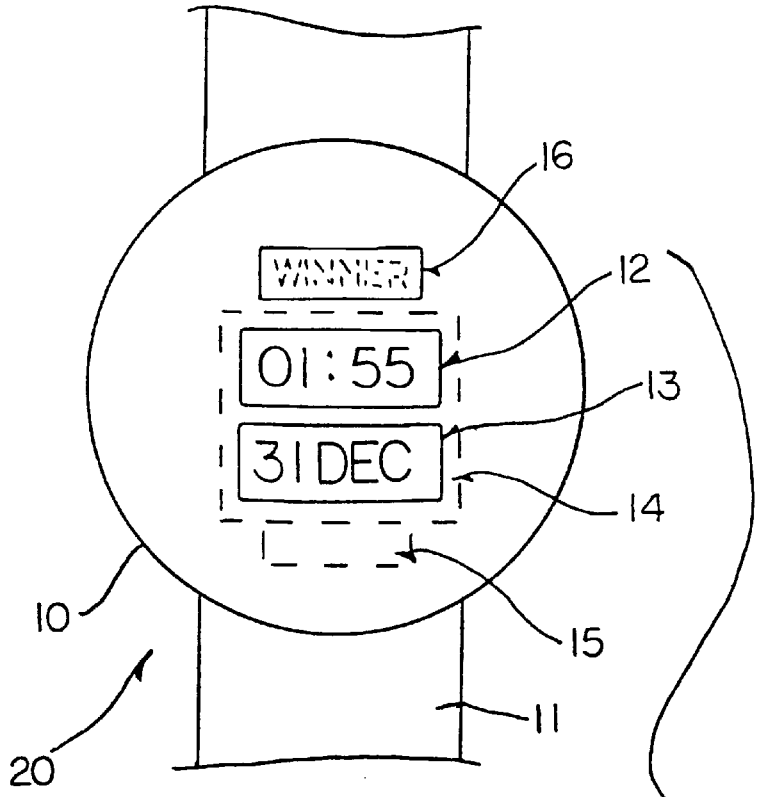
In FIG. 1 is shown two time pieces of a game apparatus according to the present invention.
Figure 1:
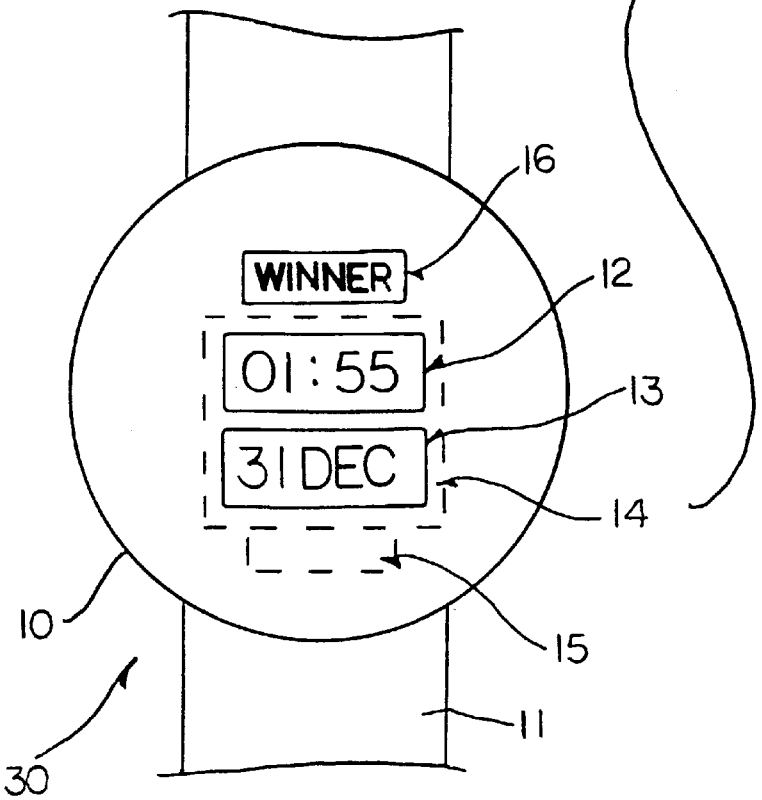

In the FIGURE, two conventional time pieces are shown in the form of a watch 10 including a strap 11 and having a display 12 for the time and a display 13 for the date. The displays are controlled a circuit board 14 which is programmed to provide the necessary displays. A battery 15 provides the necessary power. The watch is modified relative to a conventional watch in that there is an additional display 16 which can be activated to show which of the plurality of time pieces is a winner.

A winning time piece is indicated at 20 and another of the time pieces which is not a winning time piece is indicated at 30. Only the winning time piece is programmed in the control circuit 14 to activate the display 16.

The other time pieces of the game apparatus are visually indistinguishable from the winning time piece 20 but are programmed in a manner that prevents the display 16 from being activated.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A game apparatus for playing a game by a plurality of players comprising a plurality of time pieces each having means for calculating and displaying a time and a date, at least one of the time pieces being arranged to display to a player at a predetermined time and date an indication that said at least one time piece is a winner of the game, all of said time pieces being arranged such that said at least one time piece is not visually determinable by the players to be different from the other time pieces until said display of said indication.

2. The apparatus according to claim 1 wherein all of the time pieces are substantially identical.

3. The apparatus according to claim 1 wherein each of the time pieces includes a display means for displaying said indication and wherein only said one time piece is programmed to activate said display.

4. The apparatus according to claim 1 wherein said time pieces are arranged such that said predetermined time and date is midnight Dec. 31 st, 1999.

* * * * *